United States Patent [19]

McDowell

[11] Patent Number: 5,074,103

[45] Date of Patent: Dec. 24, 1991

[54] BOTTLE LOADING MACHINE AND METHOD

[75] Inventor: James E. McDowell, Orlando, Fla.

[73] Assignee: McDowell International Packaging

[21] Appl. No.: 601,932

[22] Filed: Oct. 23, 1990

[51] Int. Cl.[5] ..... B65B 35/40

[52] U.S. Cl. ..... 53/495; 53/246; 53/443

[58] Field of Search ..... 53/495, 493, 497, 443, 53/444, 246, 244

[56] References Cited

U.S. PATENT DOCUMENTS

| | | | |
|---|---|---|---|
| 2,971,309 | 2/1961 | Miskel et al. | 53/246 X |
| 3,517,478 | 6/1970 | Winch et al. | 53/246 X |
| 3,735,561 | 5/1973 | Wood | 53/246 X |
| 4,833,866 | 5/1989 | Newton et al. | 53/246 X |
| 4,862,677 | 9/1989 | Roberts et al. | 53/246 X |

FOREIGN PATENT DOCUMENTS

| | | | |
|---|---|---|---|
| 1455999 | 9/1966 | France | 53/246 |

*Primary Examiner*—James F. Coan

*Attorney, Agent, or Firm*—Richard H. Stern

[57] ABSTRACT

An automatic bottle-loading machine is described in which filled water bottles are conveyed through an automatic turning apparatus to a loading station where the bottles rest on their sides. At the same time, an empty bottle rack is loaded into an elevator and automatically delivered to the loading station. A pusher mechanism automatically pushes bottles onto a shelf of the rack. The automatic procedure is repeated with successive shelves of the rack until the rack is filled. The filled rack is then discharged from the machine and the machine is ready for the next rack.

23 Claims, 5 Drawing Sheets

BOTTLE LOADING MACHINE AND METHOD

BACKGROUND

Standard 5-gallon filled water bottles are heavy and awkward to handle manually. They weigh approximately 50 pounds apiece and are difficult to grasp. While it has long been recognized that it would be desirable to automate the loading of filled water bottles into racks, a practical and efficient fully-automatic product for this purpose has been unavailable in the marketplace.

An example of a current state-of-the-art bottle loader is the Crystal Rock Rail Loader. This is a semi-automatic machine. The unit requires presence of a full-time operator, who hand-actuates the nonautomated operations that the machine performs. The nonautomated operations include manhandling the bottle racks to a bottle-loading station, then into successive locations in registration with the bottle loader at the loading station, and then away from the loading station after the rack is filled. The requirement of a full-time operator adds considerably to the cost of loading bottles, and results in a much slower than optimal loading operation. It is believed that 1200 bottles per hour represents the maximum loading rate attained with state-of-the-art bottle loaders such as the Crystal Rock Rail Loader.

Although the foregoing difficulties have existed for a long time, to date no device known to the inventor has been provided that overcomes them. It is believed that no fully automatic, self-contained machine capable of lifting bottles rapidly and efficiently into metal racks has ever been disclosed. The objects of this invention include providing means for accomplishing the foregoing functions.

DRAWINGS

SUMMARY

The bottle loading machine of this invention provides a fully automatic, self-contained machine that has loaded standard 5-gallon filled water bottles into standard 40-bottle metal racks at a rate in excess of 1800 bottles per hour.

A powered conveyor carries filled bottles to a turning apparatus, which rotates them to their sides and delivers them to a gravity conveyor. The bottles are then delivered to a bottle-loading station where a pusher mechanism will subsequently push them onto a shelf of a rack.

While the bottles are conveyed to the bottle-loading station, an empty rack is delivered to an elevator. The empty rack is automatically raised to a full-up position, such that the bottom shelf of the rack is level with the bottle-loading station. Bottles are then automatically pushed onto the bottom shelf of the rack.

After the bottom shelf of the rack is filled, the elevator automatically lowers the rack one level. Another shelf of the rack is filled with bottles. The cycle continues until the rack is filled. The full rack is discharged and the whole cycle repeats with another rack.

DETAILED DESCRIPTION OF PREFERRED EMBODIMENT

Filled bottles conveyed to loading station

Figure 1:
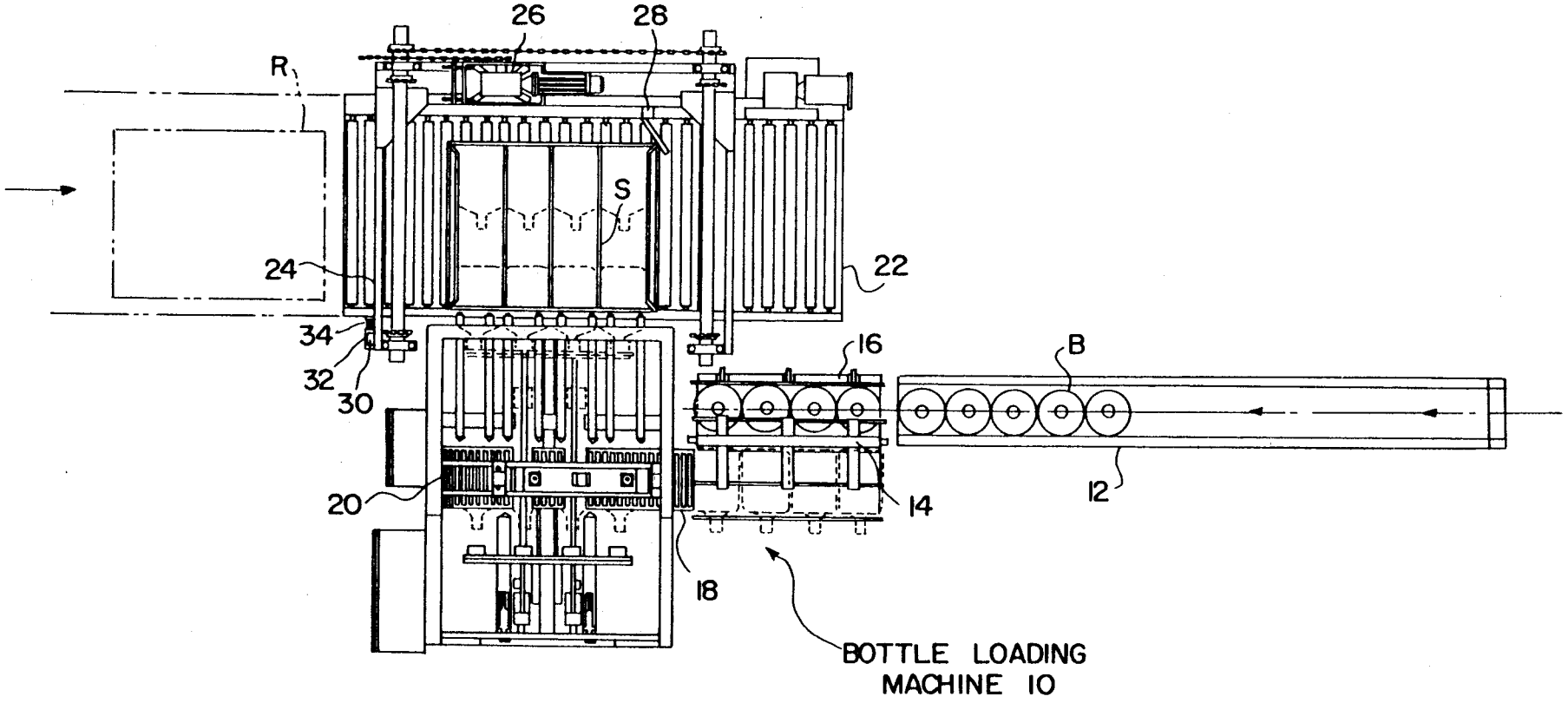
FIG. 1 is a plan view of the inventor's bottle loading machine in operation.
Figure 2:
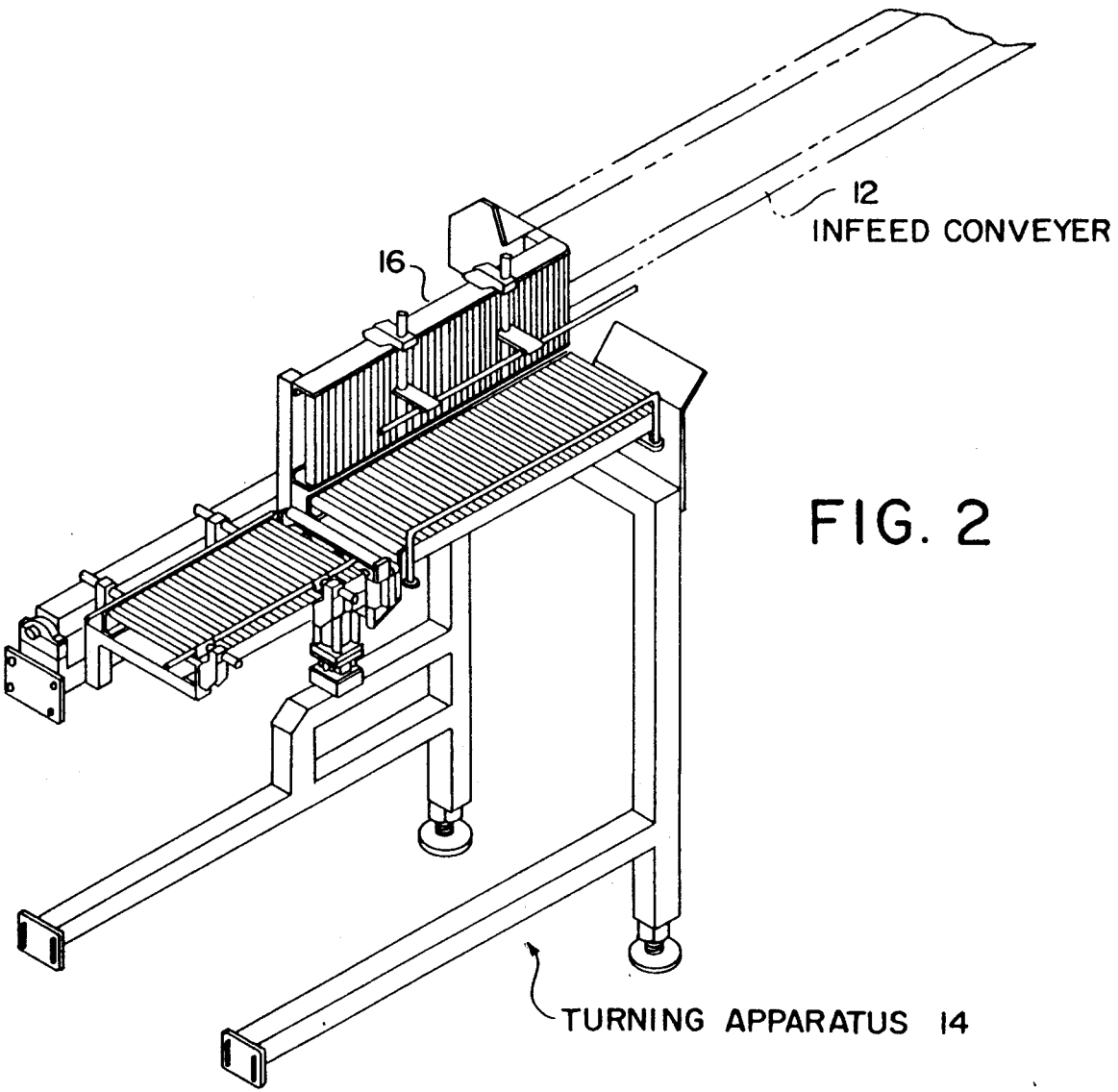
FIG. 2 shows a perspective view of the turning apparatus, including its pneumatically actuated rotating table.

As shown in FIG. 1, filled upright water bottles B are fed into bottle-loading machine 10 by means of powered infeed conveyor 12. Conveyor 12 elevates the bottles typically from a height of 2–3 feet to a height of approximately 5–6 feet, the maximum height of the conveyor, with an incline of about 15–20 degrees. At the maximum height, the conveyor levels off and conveys the upright bottles into automatic turning apparatus 14, shown in FIG. 2.

Figure 3:
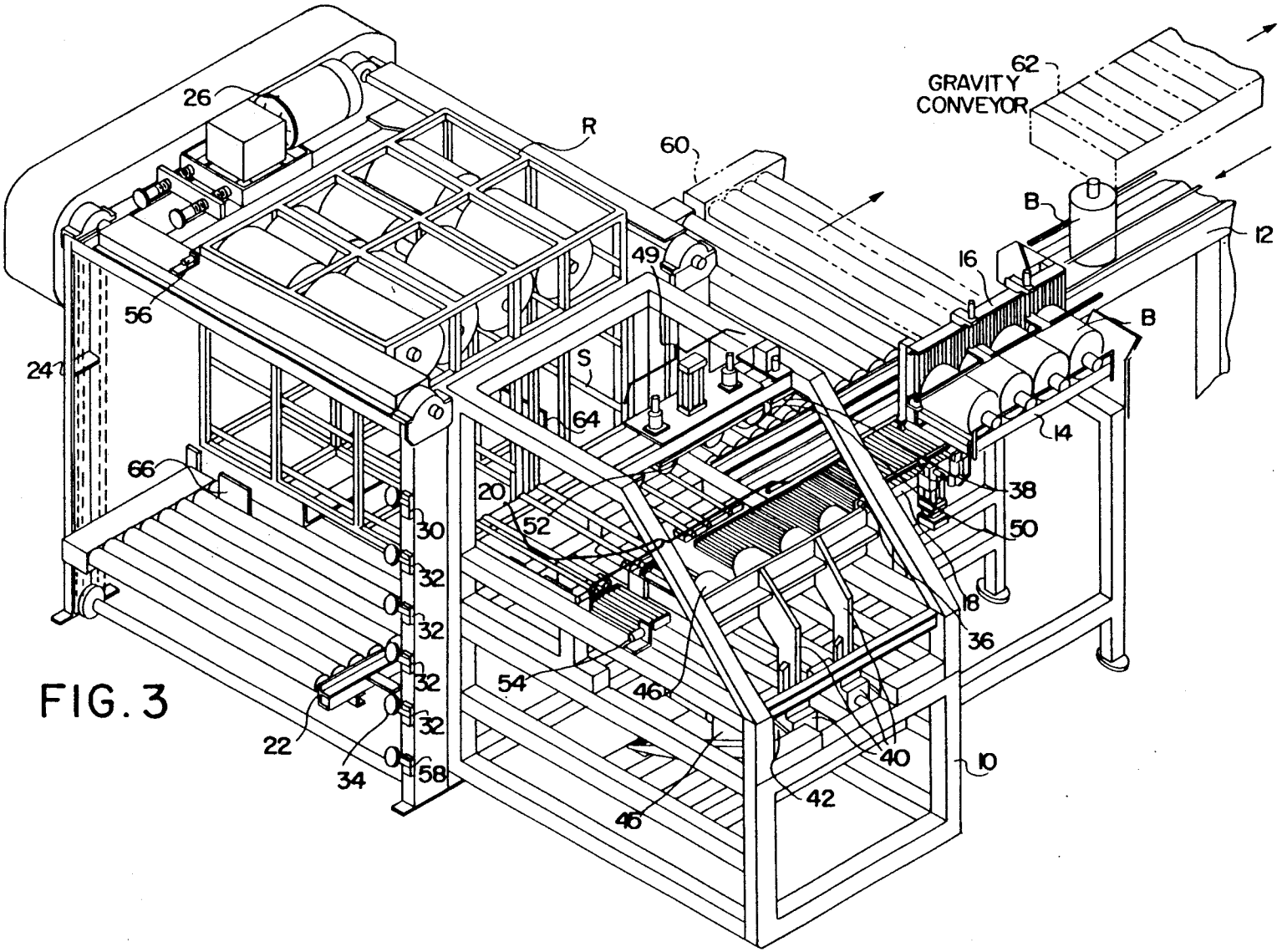
FIG. 3 show a perspective view of the bottle-loading station, showing the pusher mechanism pushing bottles onto a shelf of a rack.

As the upright bottles B move through turning apparatus 14, a pneumatically actuated rotating table 16 turns the upright bottom 90 degrees. Each bottle then becomes horizontal, with its former vertical axis now in a plane parallel to the ground and approximately perpendicular to the direction of travel of infeed conveyor 12. The bottles B then move from turning apparatus 14 via gravity conveyor 18 to bottle-loading station 20, where they rest on their sides with their necks pointing to one side of the bottle-loading station, as shown in FIG. 3.

The inventor tried an embodiment using mechanical turn guides, with powered conveyor 12 operating at a slight downward incline to carry the bottles through the turn guides. While it is possible to automatically turn bottles on their sides in this manner, the inventor considers it preferable to adopt the embodiment described above using pneumatic rotating table 16.

In the inventor's preferred embodiment, automatic turning apparatus 14 is an integral part of the bottle-loading machine. However, two alternative approaches can be used. In one, the bottles are hand-turned before being fed to an infeed conveyor for the bottle-loading machine. In the other, the automatic turning apparatus is a separate unit, which may be located at a distance from the rest of the bottle-loading machine. Under this approach, upright bottles are fed to the automatic turning apparatus and subsequently the horizontal bottles are fed to an infeed conveyor for the bottle-loading machine.

Empty racks loaded on elevator and raised

While bottles are being transported via infeed conveyor 12, empty bottle racks R are loaded into a powered rack conveyor 22. Typical water bottle racks, for which the embodiment described herein is designed, hold 40 filled bottles B per rack, loaded on their sides. The bottles are approximately 2 feet high and 1 foot in diameter. There are 5 shelf levels, each shelf S holding 8 bottles. The 8 bottles on each shelf are 2 bottles deep (approximately 4 feet) and 4 bottles wide (approximately 4 feet). The racks are loaded on rack conveyor 22 so that the direction of transport of the racks is that of their width. Once loaded on rack conveyor 22, the empty bottle racks R are transported to elevator 24, which is adjacent to bottle-loading station 20. Elevator 24 is powered by an electric motor 26.

When an empty rack R is conveyed onto elevator 24 and is fully in position, rack R triggers a switch 28. Switch 28 may advantageously be a microswitch or a light-beam interruption switch or a proximity switch, all of any conventional type. In the inventor's present preferred embodiment, switch 28 is an Allen Bradley brand Limit Switch, Model No. 802T-A3. It is actuated when an empty rack R fully enters the elevator, pressing against limit switch 28.

When actuated, switch 28 turns off power to rack conveyor 22, thereby stopping it, and starts electric motor 26 of elevator 24. Elevator 24 then elevates empty rack R to the full-up position. In that position, the bottom shelf of the rack is aligned with the floor of bottle-loading station 20, on which filled bottles B are located, as previously described. That puts the bottom shelf at a height of approximately 5–6 feet.

Elevator control

It is necessary to have an elevator control unit that will start elevator motor 26, whenever that is necessary to move a rack R. Rack R must be moved successively to heights such that each shelf S of rack R is in turn level with (in registration with) the floor of bottle-loading station 20, thus permitting filled bottles B to be pushed from station 20 onto each shelf S in turn. The elevator control unit must stop elevator motor 26 each time when such a height is reached. The inventor has built and used two different embodiments of such an elevator control unit.

Photoelectric shelf-registration detector

A first embodiment of an elevator control unit used photoelectric detection for sensing registration of shelves and bottle-loading station. Reflecting tape strips were placed on the end of each shelf S of each rack R on which bottles B are to rest. For a standard five-level rack, that required five taped locations, each vertically spaced from one another approximately 1 foot.

When a shelf S is in correct registration with bottle-loading station 20, the tape reflects light from a light source to a photodetector. The detector then provides a shelf-registration signal indicating correct registration between a shelf S and station 20.

In this embodiment, when the elevator is raised to its maximum full-up position (approximately 6 feet above the initial level), a conventional counter counts until the photodetector receives five successive signals from the five reflecting tape strips. The fifth such signal is caused by the tape on the bottom shelf, which indicates that the rack is in its full-up position with the bottom shelf as high as station 20 and in registration therewith. The counter then signals the elevator control unit to stop the elevator motor and reverse direction.

Subsequently, other control circuitry (described below) causes the elevator motor to start when a shelf S is filled with bottles; the elevator descends; and the motor continues operating until the reflecting tape on the next higher shelf causes the counter to detect an additional increment of one. That indicates that the next shelf S is in registration with station 20. The counter then sends a signal to the elevator control unit to stop the elevator motor. This procedure repeats as the rack is successively lowered one shelf level at a time.

Mechanical shelf-registration detector

In a second, and preferable, embodiment a limit switch 30 similar to limit switch 28 (Allen Bradley brand Limit Switch, Model No. 802T-A3) is fixed on the frame of elevator 24 so that switch 30 is actuated when the rack reaches full-up position. (The lowest shelf S of rack R is then at the approximately 6 foot height of bottle-loading station 20.) Actuation of switch 30 provides a full-up position signal that actuates elevator control unit circuitry that stops and reverses elevator motor 26.

Figure 5:
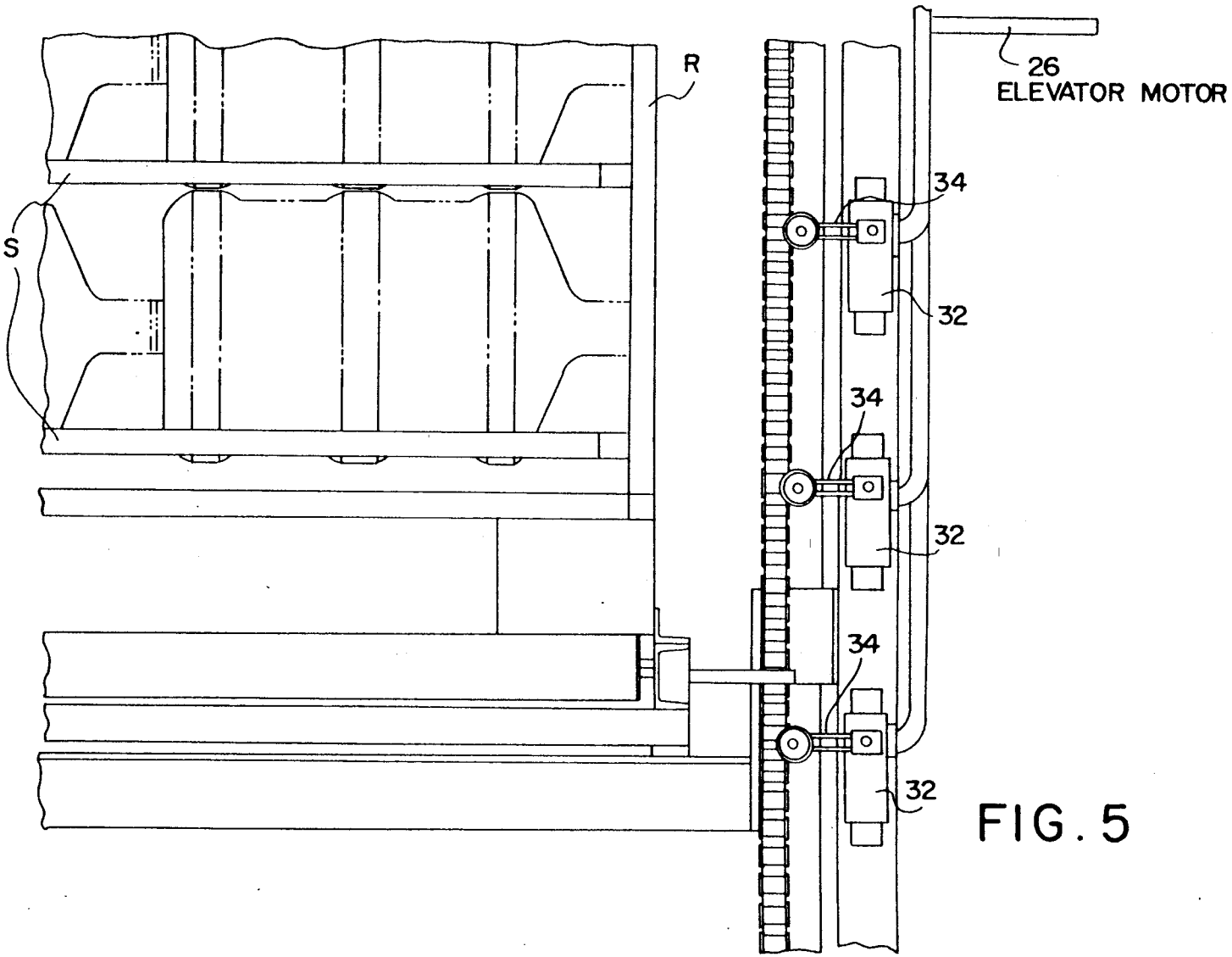
FIG. 5 shows a detailed view of the mechanism for stopping motion of the rack elevator when a shelf of a rack is at the same height as the loading station.

A further shelf-registration switch 32 is equipped with a spring-loaded pivoted rocker arm 34 that temporarily engages with and thus is actuated by each shelf S of rack R as it descends, but is just tipped up by each shelf S when rack R ascends. Each time that a descending shelf S temporarily presses against spring-loaded pivoted rocker arm 34, as shown in FIG. 5, that causes switch 32 to be actuated. That in turn actuates elevator control unit circuitry that turns off elevator motor 26 and stops the elevator. Switch 32 is positioned at a height such that the switch-actuating shelf S of rack R is at the same height as the floor of bottle-loading station 20 when it actuates switch 32.

Other circuitry (described below) reactuates motor 26 when the shelf S is subsequently filled with bottles B. The elevator then lowers rack R; the shelf descends below rocker arm 34; the rocker arm springs back into position; and it is ready to be actuated again when the next shelf S of rack R descends to the same height as loading station 20.

A further variation on the foregoing embodiment has been developed for the commercial version of the machine in use at the time that the present patent application was filed, and the inventor considers this variation now to be the most preferred embodiment of the invention. This embodiment is shown in FIGS. 3 and 5.

A limit switch 30 and a plurality of further shelf-registration switches 32, each equipped with a spring-loaded rocker arm 34, are mounted to the frame of bottle-loader 10 at predetermined heights. There is one such switch for each shelf level of rack R onto which bottles B' will be loaded. Thus, in FIG. 3 there is one switch 30 and four switches 32, to accommodate a five-shelf rack.

An elevator arm (or "dog") projects from the floor region of elevator 22, as shown in perspective in FIG. 3 and in profile in FIG. 5. In FIG. 3 the elevator arm is shown just above and touching the top of rocker arm 34 of the lowest switch 32, while in FIG. 5 the elevator arm is shown slightly above the lowest rocker arm 34.

Switch 30 is actuated by arm 34 to function as described above. Each of switches 32 is successively actuated by the elevator arm as elevator 22 descends, in like manner as described above. The switches are placed at a height relative to the elevator arm such that the elevator arm trips the rocker arm 34 of the switch just when the rack shelf corresponding to the switch is in proper vertical registration with the floor of loading station 20.

The main difference between this variation and the second embodiment, described above, is that here there are separate switches 30 for each shelf level, tripped by a single element (the elevator arm as it descends), instead of one switch 30 successively tripped by the different shelves as they descend.

Other expedients may be devised or may be adapted from existing elevator art to "bring the rack to the right floor," without departing from the concept of the invention. What is of principal importance is that the various shelves of the rack should automatically be brought successively into appropriate registration with the floor of the bottle-loading station, thereby permitting bottles to be loaded onto each shelf of the rack.

Bottles pushed onto rack

Bottle fill for loading station

Loading station 20 has room for four bottles, on their sides, as shown in FIG. 3. Whenever four bottles B fill up loading station 20, by being conveyed there via conveyors 12 and 18, a photoelectric control device 36 is actuated to send a signal indicating a filled-station condition. Photoelectric control device 36 includes a counter, which increments by one each time that a bottle passes a light beam and interrupts it as the bottle enters loading station 20. When the count of bottles entering loading station 20 reaches four, control device 36 sends a filled-station signal and resets the counter to zero. While it would be possible to use a microswitch or a proximity switch, or a limit switch similar to switch 28, for the purpose of automatically ascertaining when bottle-loading station 20 is filled and then generating a filled-station signal, the inventor has found it advantageous to use a photoelectrically actuated counter set for the proper count corresponding to the desired number of bottles, as described above.

It has been found unnecessary to use a powered conveyor as the floor of bottle-loading station 20 in order to assure proper fill of the station. While that can be done without departing from the concept of the invention, the inventor considers that use of such a powered conveyor adds needless expense. Rather, it is considered satisfactory just to rely on a gravity conveyor 18 to deliver bottles to the entry to the station and to let the later incoming bottles push the earlier ones across the station to its farther end, thereby actuating control device 36.

When actuated, control device 36 sends a filled-station signal to control circuitry that turns off powered conveyor 12, and causes a barrier gate 38 to descend across gravity conveyor 18, barring entry to bottle-loading station 20. (Alternatively, a barrier stop may be raised.) Thus bottles B do not pile up and jam the entry to bottle-loading station 20. It is possible to dispense with gate 38 if the downward gradient of gravity conveyor 18 is made so slight (or even made negative) that bottles B do not move under their own power and move only when pushed from behind by other bottles. It is also possible to power conveyor 18 instead of relying on gravity, and to use the filled-station signal to deactuate the power thereby stopping forward movement of bottles. But the preferred embodiment uses a gradient of approximately 3 to 6 degrees downward for conveyor 18, and requires a gate to insure against pile-ups.

Bottle pushing mechanism

Figure 4:
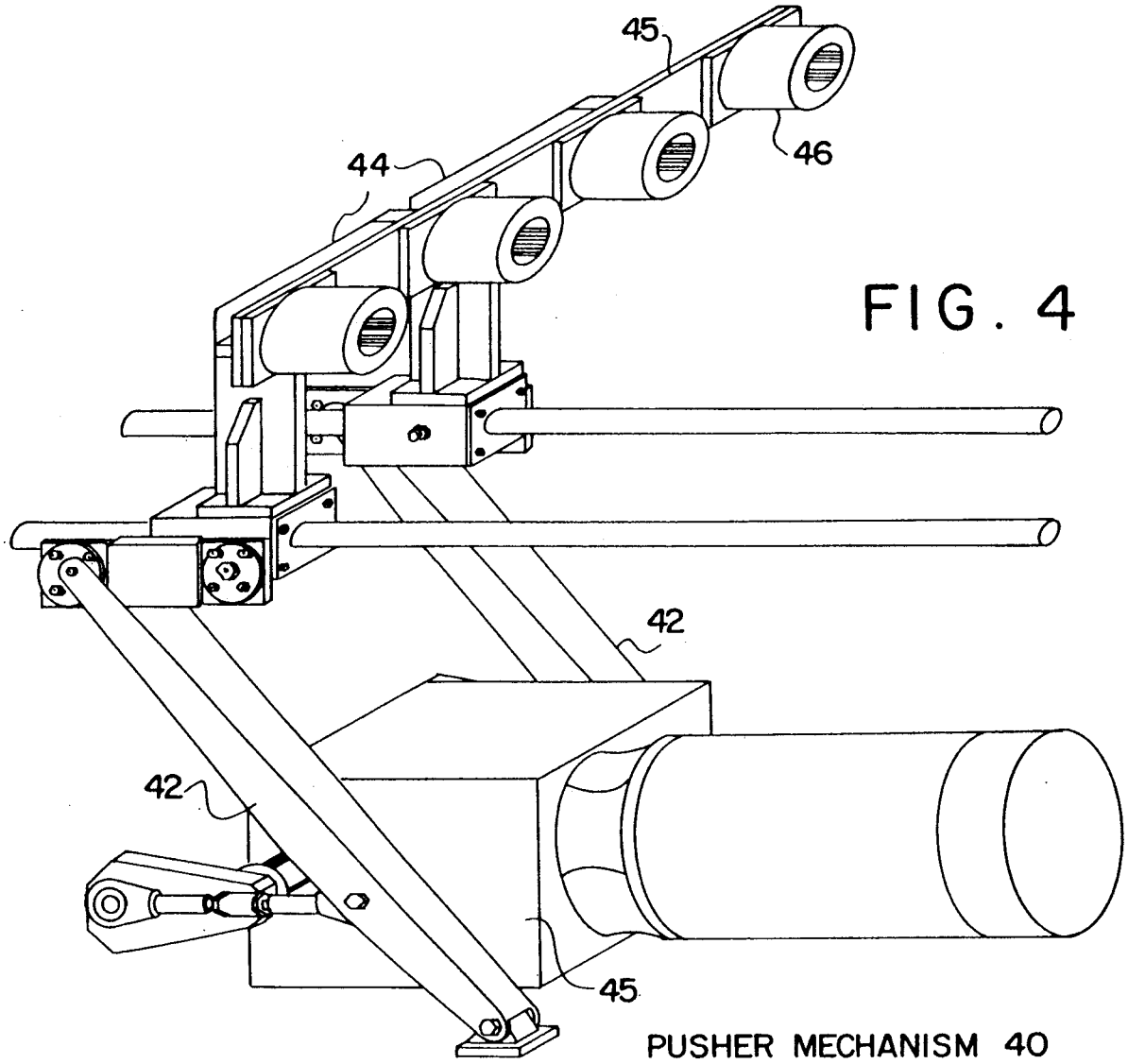
FIG. 4 shows a perspective view of the pusher mechanism, including the pusher paddle, from a vantage point facing the paddle.

After control device 36 turns off conveyor 12, control device 36 actuates a pusher mechanism 40, shown in FIG. 4. Pusher mechanism 40 is located on the side of bottle-loading station 20 toward which the necks of bottles B point. This is the opposite side of the station from where rack R and elevator 24 are located. Pusher mechanism 40 includes a reciprocating arm 42, driven by a pusher power unit 45. Unit 45 is a variable-speed ¾-HP electric motor driving a double-output-shaft 60:1 gearbox.

Arm 42 reciprocates in the same direction as the longitudinal axes of the filled bottles B. On the end of arm 42 facing the necks of bottles B, a pusher paddle 44 is fixed. Pusher paddle 44 includes a set of four longitudinally spaced plastic ("Teflon") sockets 46 mounted on a common bar 48. The sockets are so spaced that they are each one bottle diameter (approximately 1 foot) apart. Their height above the floor of the bottle-loading station is one half bottle diameter, which is approximately on the center line of the shelf opening of the rack. This permits sockets 46 of pusher paddle 44 to engage the necks of all four bottles in loading station 20, in preparation for pushing them onto the shelf of rack R. Before pusher mechanism 40 is actuated, arm 42 is in its full-rear position.

When pusher mechanism 40 is actuated, arm 42 moves toward filled bottles B, and sockets 46 of pusher paddle 44 engage with the necks of bottles B. Pusher paddle 44 then pushes the four waiting bottles B from bottle-loading station 20 half-way into the adjacent shelf S of waiting rack R; this distance is the height of an upright bottle (about 2 feet). Arm 42 is now in its full-forward position, extending all the way across station 20 to the rack. The length of travel of arm 42 is approximately the 2-foot height of an upright bottle B. Arm 42 then retracts away from rack R back to its full-rear position.

Before pusher mechanism 40 is actuated, it is desirable to insure that the necks of bottles B are correctly laterally spaced from one another, so that sockets 46 will correctly engage with the bottle necks. As a first measure, bottle-loading station 20 is very nearly the same length as four bottle diameters (i.e., 4 feet). As a second measure, the inventor has found it expedient to lower a bottle-spacer mechanism 49, comprising a bar 50 to which are attached downwardly extending half-round spacer bars 52, about 5 inches wide in diameter and about 12 to 15 inches long. Thus, before pusher mechanism 40 is actuated, bottle-spacer mechanism 49 is lowered; spacer bars 52 descend between bottles B, extending longitudinally parallel to the bottle axes and pressing along the sloping sides of the bottles, thereby insuring correct lateral positioning of the bottles so that sockets 46 will be coaxial with bottles B and engage their necks. Then, pusher mechanism 40 is actuated as described in the preceding paragraph; sockets 46 engage with the bottle necks; bottle-spacer mechanism 49 is raised again, so that it is out of the way of pusher mechanism 40; and bottles B are pushed into shelf S as described in the preceding paragraph.

Equivalent means can be used to insure correct lateral spacing of the bottles. Thus, plastic bumpers can be bolted onto the floor of bottle-loading station 20, laterally spaced from one another to accommodate the bottles and space them apart correctly. The bumpers cause bottles B to settle into and remain in the desired positions on the floor of loading station 20. Instead of bumpers, two plastic rails for each bottle can be bolted onto the floor of bottle-loading station 20, again laterally spaced from one another to accommodate the bottles and space them correctly.

After bottles B are pushed onto shelf S, arm 42 returns to its full-rear position and no longer extends across bottle-loading station 20 obstructing it. A photoelectric sensor device 54 then senses that condition and sends a signal to turn conveyor 12 on again and raise barrier gate 38. Another four bottles B are then transported into loading station 20. When that occurs, device 36 turns off conveyor 12, lowers barrier gate 38, and actuates pusher mechanism 40. The bottle-pushing cycle is repeated. This time, the four bottles that are pushed half-way into the rack push the four bottles that are already in the rack the remaining distance (approximately 2 feet) across the shelf to the far side of the rack, so that the shelf is now filled with eight bottles.

While a standard eight-bottle rack has been described, it would be possible to use a rack with only four bottles (1×4) per shelf. In that case, there would only be one pusher cycle per shelf. Also, it is conceivable that one might use a 12-bottle (3 ×4) shelf, in which case there would be three pusher cycles per shelf. Other variations are possible and the invention is not limited to any particular such shelf arrangement.

Elevator moves rack down one level

When a line of four bottles is pushed all the way to the rear of the shelf, a photoelectric sensor device 56 is automatically actuated to send a signal indicating that the shelf is filled. It is possible to utilize another type of sensor, such as a proximity switch mounted near the far side of the rack, or a microswitch equipped with an appropriately sized "cat's whisker," but the inventor has found it advantageous to use a photoelectric control switch. When actuated, sensor device 56 sends a filled-shelf signal that causes the motor of elevator 24 to start, thereby automatically lowering rack R. The elevator motor continues to operate until automatically stopped by shelf-registration switch 32, as previously described. This procedure automatically lowers the rack approximately 1 foot, so that the next higher empty shelf S of rack R now faces loading station 20.

Continuation of loading cycle

The same procedure by which eight bottles are automatically pushed into rack R occurs again.

In the same manner, elevator 24 automatically lowers rack R and another eight bottles are automatically loaded. This procedure continues until all five levels of rack R are automatically filled.

Again, automatic operation with a standard five-level rack was described. But the invention can be practiced with other racks. It is just a matter of setting up the machine for the desired form of rack. The details of that procedure will be obvious to a person of ordinary skill in this art. The principal parameters that need to be varied are the physical placement of the limit switches to correspond to the height dimensions of the rack, and (where photoelectric detection with counters is used) setting counters to register an appropriate number of shelf levels or bottles.

Discharge of filled rack

Upon completion of the last shelf-filling cycle, the rack may or may not be at the lowest level of the rack elevator, depending on how the machine is configured for the particular location. If the rack is at the lowest level, the filled rack should simply be discharged from the elevator without further elevation down. But if the rack is several feet above the lowest level, it is necessary to lower the rack all the way to the lowest level, unless the configuration for the particular location calls for discharge of filled racks from the elevator at a raised level (for example, to facilitate use of a gravity conveyor). Which of these configurations is used is a matter of design choice and convenience, and the appropriate choice is readily implemented by designers of ordinary skill in this art.

In the configuration in which the highest shelf of the rack is filled at a level leaving the rack above discharge level, the frame of elevator 24 carries another limit switch 58, similar to the others. Switch 58 is fixed to the frame at a location such that switch 58 is automatically actuated when the elevator has moved rack R to the full-down position. Switch 58 then sends a signal that turns off elevator motor 26 and actuates powered discharge conveyor 60 located adjacent to elevator 24. Discharge conveyor 60 then automatically transports rack R a short distance to a gravity roller conveyor 62, which conveys rack R to a nearby station at which a forklift truck is located, so that the rack of filled bottles can be stored or be loaded on a truck for delivery to a customer site.

In the inventor's preferred embodiment for this configuration, elevator 24 has an entry side and an exit side, opposite one another and at right angles to the side adjacent to the side of the elevator facing the bottle-loading station. The floor of the elevator has a small powered conveyor, which runs in the direction from the entry side to the exit side. A powered rack conveyor delivers an empty rack to the entry side of the elevator, on which the rack is stopped mechanically with an exit barrier 64, which is a mechanical stop raised from below the floor level of the elevator. The power to the rack conveyor is turned off by a limit switch 28, as previously described; and an entry barrier 66, which is a mechanical stop raised from below the floor level of the elevator, is actuated to keep the rack from falling out via the entry side of the elevator. Also, as previously described, elevator 24 then automatically rises, all shelves are filled, and the elevator descends to the initial level. The filled rack is then discharged via the exit side of elevator 24, via powered discharge conveyor 60, as previously described, after exit barrier 64 is deactuated (that is, the stop is lowered). Then entry barrier 66 is deactuated (that is, the stop is lowered) and a new cycle begins with another empty rack.

General Concluding Remarks

It is thus seen that the machinery described hereinabove achieves the objects of the invention described earlier, providing a fully-automatic bottle loader.

It will be appreciated that variations in structure can be devised without departing from the spirit and concept of this invention. For example, the inventor believes that the most convenient procedure for loading heavy, filled bottles is to raise the empty rack R to a height such that its bottom shelf is level with the floor of loading station 20. Then the rack is filled level-by-level from bottom shelf level to top shelf level, and is lowered progressively after each level is filled. However, it would be possible to start by loading the top shelf, and then to raise the rack progressively until the bottom shelf was filled, and then to lower the filled rack to the floor.

It is believed that it is preferable not to keep raising a progressively heavier rack, but instead to raise the rack when it is lightest and thereafter to lower it as it gets heavier. Hence, the invention is specifically described and claimed below in terms of that preferred embodiment. Nevertheless, it is considered that the same invention can be carried out by what the inventor considers the less preferable procedure. Accordingly, it is believed that the latter is an equivalent, albeit more complex and expensive, procedure for accomplishing the same thing in the same way.

Similarly, it would be possible to exploit the spirit and concept of the invention, although the inventor considers it technically unsound, to fill the shelves in some other zig-zag order, moving the rack up and down in doing so. That too is an equivalent, albeit inferior, procedure.

The invention is not restricted to water bottles. The machine is capable of automatically loading other heavy bottles, such as those filled with sulfuric acid or other liquids. In the event that there is a risk of leakage in the case of corrosive liquids, it is necessary to use corrosion-resistant metals for exposed parts, rather than ordinary steel.

As used in the claims, "elevating" and "elevation" refer both to raising and lowering of the bottle rack, that is, to any vertical displacement of the rack. For example, the described "elevating means" ordinarily raises the rack until its bottom shelf is level with the loading station, then successively lowers the rack one shelf level at a time, and then lowers the rack to approximately floor level (unless the rack is already lowered to floor level).

As used in the claims, the term "a said height" refers to, and has as antecedent, one of the "heights" mentioned in the first claim "at which a said shelf of the bottle rack is as high as the bottle-loading station." That is a height at which a shelf is in registration with the bottle-loading station. When reference is made to a shelf being "as high as" the loading station, it should be understood that the height tolerance, or the deviation from exactness of equality in height, will be that ordinarily used in this art, since the bottles should not bump or catch when pushed from the loading station onto the shelf.

As used in the claims, "stopping means" refers to the arrangements described above in the section captioned Elevator Control whereby a control device deactuates the elevator motor when a shelf comes into registration with (i.e., is at the same height as) the loading station; this is a "said height," as described above. Such stopping means also include equivalent means, such as a disengageable clutch, fluid coupling, or a brake.

As used in the claims, "means for temporarily engaging with a portion of the rack" refers to the pivoted rocker arm for a shelf-registration switch, which temporarily actuates the switch when the edge of a shelf presses against the rocker arm. Such means also include equivalent means. For example, instead of a shelf edge, a "dog" or other projection on the rack can be used to engage the rocker arm temporarily and actuate the switch.

In some instances, it is possible to combine two elements into a single device while still accomplishing the same function in the same way. Thus, the two bottle conveyors, one powered and one unpowered, can be combined into a single powered conveyor that carries upright bottles through a turning apparatus, thereby turning the bottles on their sides and delivering them to the bottle-loading station. The inventor considers this a less preferred embodiment, but nevertheless it is within the scope of the invention. Similarly, the maximum-height sensor device and the shelf-registration sensor device may be combined into a single device by modifying the shelf-registration switch to operate with a counter so as to stop the ascending elevator at a count of five shelf actuations.

It is also possible in some instances to use two devices to accomplish the function of one element. For example, it is possible to use a gravity conveyor in places where a powered bottle conveyor is described herein, by elevating the bottles first and then allowing them to descend to the given location by the gravity conveyor. In a similar way, one could deliver an empty rack to a location at which its bottom shelf was as high as or higher than the bottle-loading station, and then lower the rack shelf-by-shelf without initially elevating it. The inventor considers any of that to be an equivalent, but more complex and expensive, procedure for accomplishing the same thing, and the claims should be understood and interpreted as extending thereto.

The subject matter claimed is:

1. A machine system for automatically loading heavy bottles, weighing 40 pounds or more, into a multilevel bottle rack capable of supporting said bottles, having a bottom shelf and at least one further shelf, said machine system comprising:

a bottle-loading station having an entry side and an elevator side;

means for automatically conveying heavy bottles, weighing 40 pounds or more, to the bottle-loading station via the entry side, leaving a plurality of said bottles resting on the bottle-loading station on their sides with their longitudinal axes at right angles to the elevator side;

powered elevating means, located near the elevator side of the bottle-loading station, for displacing a multilevel bottle rack capable of supporting said bottles, in a straight vertical path, said elevating means being capable of elevating at least 500 pounds of weight;

elevation-control means for automatically controlling the elevating means to stop at heights at which a said shelf of the bottle rack is as high as the bottle-loading station and is adjacent thereto; and powered bottle-displacement means, located near the bottle-loading station, for intermittently displacing a plurality of said bottles resting on the bottle-loading station, via the elevator side thereof, said bottle-displacement means being automatically actuated at least one time after each time that the rack stops at a said height.

2. The machine system of claim 1 further comprising:

turning means for automatically turning upright bottles onto their sides; and means for automatically conveying the upright bottles through the turning means and to the means for automatically conveying the bottles to the bottle-loading station.

3. The machine system of claim 1 wherein the bottle-displacement means when actuated carries out a displacement cycle in which a portion of said means temporarily extends across the bottle-loading station and then said portion reassumes an initial position, said machine system further comprising:

barring means for automatically barring entry of bottles to the bottle-loading station after it has been filled with bottles; and means for deactuating the barring means after the bottle-displacement means has completed the displacement cycle.

4. The machine system of claim 1 further comprising:

means for automatically delivering an empty rack to the elevating means; and means for automatically causing elevation of the bottle rack to commence after the rack is loaded onto the elevating means.

5. The machine system of claim 1 further comprising:

means for causing elevation of the bottle rack initially to proceed until, and automatically stop when, the rack reaches a height such that the bottom shelf of the rack is as high as the bottle-loading station; and means for automatically actuating the elevating means to lower the rack after each time that a said shelf is filled.

6. The machine system of claim 1 further comprising means for automatically discharging the rack from the elevating means after the bottle rack is filled.

7. The machine system of claim 1 wherein the bottle-displacement means is automatically actuated a plurality of times after each time that the rack stops at a said height, and the bottle-displacement means displaces the bottles resting on the bottle-loading station to a said shelf until the shelf is filled with said bottles.

8. The machine of claim 1 wherein the elevation-control means has photoelectrically actuated means for stopping elevation of the rack when the rack reaches a said height.

9. The machine of claim 1 wherein the elevation-control means has stopping means for stopping elevation of the rack when the rack reaches a said height, and wherein the stopping means is actuated by a switch tripped by means for temporarily engaging with a portion of the rack or of the elevator.

10. An automatic bottle loader machine for loading bottles into a multilevel bottle rack having a bottom shelf and at least one further shelf, said machine comprising:

a bottle-loading station that has an entry side and an elevator side;

a bottle conveyor that carries bottles to the station via the entry side, leaving the bottles resting on the station on their sides with their longitudinal axes at right angles to the elevator side;

a rack elevator adjacent to the elevator side of the bottle-loading station and powered by a motor;

a bottle pusher located near the bottle-loading station and powered by a bottle-pusher motor, said pusher when actuated intermittently pushing the bottles resting on the bottle-loading station therefrom via the elevator side and thereafter retracting to a retracted position;

a control system automatically controlling up and down elevation of the bottle rack by the rack elevator to a plurality of heights including each height at which a said shelf of the rack is as high as the station; and displacement of the bottles onto the shelves of the rack on the rack elevator.

11. The machine of claim 10 further comprising an automatic bottle-turning apparatus for turning upright bottles onto their sides and releasing them to the bottle conveyor.

12. An automatic bottle loader machine for loading bottles into a multilevel bottle rack having a bottom shelf and at least one further shelf, said machine comprising:

a bottle-loading station that has an entry side and an elevator side;

a bottle conveyor that carries bottles to the station via the entry side, leaving the bottles resting on the station on their sides with their longitudinal axes at right angles to the elevator side;

a rack elevator adjacent to the elevator side of the bottle-loading station and powered by a motor;

a bottle pusher located near the bottle-loading station and powered by a bottle-pusher motor, said pusher when actuated intermittently pushing the bottles resting on the bottle-loading station therefrom via the elevator side and thereafter retracting to a retracted position;

a control system automatically controlling up and down elevation of the bottle rack by the rack elevator to a plurality of heights including each height at which a said shelf of the rack is as high as the station; and displacement of the bottles onto the shelves of the rack on the rack elevator;

a filled-station sensor device for automatically sending a filled-station signal when bottles fill the bottle-loading station, said signal thereby automatically actuating a stopping device that stops bottles from entering the bottle-loading station when the control system receives a filled-station signal;

a retraction sensor device for automatically sending a retraction signal after the bottle pusher has pushed bottles from the bottle-loading station and returned to the retracted position, said signal thereby automatically deactuating the stopping device;

a loaded-rack sensor device for automatically sending a loaded-rack signal when the rack has been loaded onto the elevator, said signal thereby automatically starting the elevator and raising the rack;

a maximum-height sensor device for automatically sending a maximum-height signal when the elevator has raised the rack to a height such that the bottom shelf of the rack is as high as the bottle-loading station and is adjacent thereto, said signal thereby automatically stopping the elevator and reversing the direction of motion thereof in preparation for a next actuation thereof; and then automatically actuating the bottle pusher, thereby causing bottles to be automatically pushed from the bottle-loading station onto the bottom shelf;

a filled-shelf sensor device for automatically sending a filled-shelf signal when bottles fill a said shelf, said signal thereby automatically actuating the elevator and lowering the rack;

a shelf-registration sensor device for automatically sending a shelf-registration signal when the rack reaches a further said height such that a said further shelf is as high as the bottle-loading station and is adjacent thereto, said signal thereby automatically stopping the elevator; and then automatically actuating the bottle pusher, thereby automatically pushing bottles from the bottle-loading station onto the further shelf.

13. The machine of claim 12 wherein the shelf-registration sensor device is a photoelectric detection device.

14. The machine of claim 12 wherein the shelf-registration sensor device is a switch triggered by contact with a part of the rack or of the elevator.

15. A method for automatically loading filled bottles into a multilevel bottle rack having a bottom shelf and at least one further shelf, the method comprising:

(a) Loading the rack into an elevator adjacent to which is located a bottle-loading station having an elevator side;

(b) Performing a series of bottle-transporting steps comprising:

(1) automatically conveying the bottles to the bottle-loading station, and leaving the bottles resting on the station with their longitudinal axes at right angles to the elevator side;

(2) automatically detecting, by a full-station sensor device, when the bottle-loading station is filled with bottles; and (3) thereupon automatically sending a signal from the full-station sensor device to actuate a bottle-stopping device, thereby automatically stopping any more bottles from entering the bottle-loading station;

(c) Performing a series of rack-transporting steps comprising:

(1) actuating the elevator, thereby vertically displacing the rack;

(2) automatically detecting with a shelf-registration sensor device when the elevator when the rack reaches a height such that a said shelf of the rack is as high as the bottle-loading station and is adjacent thereto;

(3) thereupon automatically sending a signal from the shelf-registration sensor device, thereby automatically stopping the elevator;

(d) After performing the bottle-transporting steps and the rack-transporting steps (1) automatically pushing the bottles resting on the bottle-loading station, beyond the elevator side and onto the shelf;

(2) deactuating the bottle-stopping device;

(3) automatically detecting with a filled-shelf sensor device when the shelf is filled with bottles; and (4) thereupon automatically sending a signal from the filled-shelf sensor device to actuate the elevator; and (e) Performing steps (b) through (d) until they have been performed for as many times as the number of shelves in the rack.

16. The method of claim 15 wherein the first time that step (c)(2) is performed the said shelf is the bottom shelf of the rack, and each successive time thereafter that step (c)(2) is performed the said shelf is a next higher further shelf of the rack.

17. The method of claim 15 wherein in step (a) the elevator is automatically conveyed to and loaded onto the elevator; a rack-sensor device automatically detects when the rack has fully entered the elevator; and the rack-sensor device then sends a signal automatically starting the elevator.

18. The method of claim 15 wherein after step (e) is completed there is a further step of automatically lowering the rack to a discharge location and automatically discharging the rack.

19. The method of claim 15 wherein step (b)(1) is preceded by the following additional steps:

automatically conveying upright filled bottles to an automatic turning apparatus; and automatically turning the bottles onto their sides by means of the turning apparatus.

20. The method of claim 15 wherein the shelf-registration sensor device photoelectrically detects when the shelf is as high as the bottle-loading station.

21. The method of claim 15 wherein the shelf-registration sensor device detects when the shelf is as high as the bottle-loading station by temporarily engaging a switch and a part of the rack or of the elevator.

22. The method of claim 15 wherein the bottles are automatically stopped from entering the station by automatically actuating a barrier against bottles coming to the station.

23. The method of claim 15 wherein the following additional steps occur between steps (d)(2) and (d)(3):

(A) again performing steps (b)(1) to (b)(3); and (B) again performing steps (d)(1) to (d)(2).

* * * * *